US007703162B2

(12) United States Patent
Vadakkeveedu et al.

(10) Patent No.: US 7,703,162 B2
(45) Date of Patent: Apr. 27, 2010

(54) MECHANICAL ACTION ESTIMATION FOR WASHING MACHINES

(75) Inventors: Kalyanakrishnan Vadakkeveedu, College Station, TX (US); Farhad Ashrafzadeh, Stevensville, MI (US); Raveendran Vaidhyanathan, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 630 days.

(21) Appl. No.: 11/601,550

(22) Filed: Nov. 17, 2006

(65) Prior Publication Data

US 2008/0115295 A1 May 22, 2008

(51) Int. Cl.
*D06F 39/00* (2006.01)

(52) U.S. Cl. ..... 8/159; 68/12.02; 68/12.04; 68/12.05; 68/12.06

(58) Field of Classification Search ..... 8/159; 68/12.02, 12.04, 12.05, 12.06, 12.16, 12.17
See application file for complete search history.

(56) References Cited

U.S. PATENT DOCUMENTS 5,669,095 A * 9/1997 Dausch et al. ..... 8/158

* cited by examiner

*Primary Examiner*—Michael Barr
*Assistant Examiner*—David Cormier
(74) *Attorney, Agent, or Firm*—Clifton G. Green; McGarry Bair P.C.

(57) ABSTRACT

An automatic clothes washer comprises a wash tub in which is disposed a wash basket defining a wash chamber for receiving fabric articles, and an article mover located within the wash chamber and driven by a motor to impart mechanical energy to the fabric articles upon contact. A method for controlling the operation of the automatic clothes washer comprises determining the work imparted to the fabric articles by the article mover, and controlling an operating cycle of the automatic washer based on the determined work.

18 Claims, 7 Drawing Sheets

MECHANICAL ACTION ESTIMATION FOR WASHING MACHINES

BACKGROUND OF THE INVENTION

1. Field of the Invention

The invention relates to a method for controlling the operation of an automatic clothes washer.

2. Description of the Related Art

Automatic clothes washers are ubiquitous. Such appliances clean fabric items effectively, enabling the homeowner to complete other tasks or engage in more satisfying activities while doing the laundry. Modem clothes washers provide a multitude of options for matching a selected cleaning operation to the type of fabric comprising the laundry load and the degree of soiling of the laundry load.

In a conventional automatic clothes washer, cleaning of the fabric items is primarily attributable to three factors: chemical energy, thermal energy, and mechanical energy. These three factors can be varied within the limits of a particular automatic clothes washer to obtain the desired degree of cleaning.

The chemical energy is related to the types of wash aids, e.g. detergent and bleach, applied to the fabric items. All other things being equal, the more wash aid that is used, the greater will be the cleaning effect.

The thermal energy relates to the temperature of the fabric items. The temperature of the wash liquid typically is the source of the thermal energy. However, other heating sources can be used. For example, it is known to use steam to heat the fabric items. All things being equal, the greater the thermal energy, the greater will be the cleaning effect.

The mechanical energy is attributable to the contact between the clothes mover and the fabric items, the contact between the fabric items themselves, and the passing of the washing liquid through the fabric items. In washing machines with a fabric mover, the fabric mover tends to cause the fabric items to contact themselves, and for the wash liquid to pass through the fabric items. All things being equal, the greater the amount of mechanical energy, the greater will be the cleaning effect. The longer the time during which the fabric items contact the clothes mover and other fabric items, the greater the amount of mechanical energy delivered to the laundry load.

It has not yet been possible to determine the amount of mechanical energy imparted to a particular wash load. Typically, the mechanical energy imparted to a load is estimated based on empirically determined data from a development laboratory that is then stored within the controller for utilization in clothes washers in use in customer homes. The empirical data is normally determined for pre-determined operation conditions such as: load weight, fabric type, and liquid level. However, not every possible combination is tested and stored in the machine as it is impractical. Nor is it possible to do so because the actions of the user cannot be anticipated. For example, a user might mix fabric types, say, normal and delicate, and then pick a delicate wash cycle. Therefore, the empirical data is, to some degree, a best guess of the mechanical energy imparted to the clothes load.

The use of empirical data can lead to either too much or too little mechanical energy being imparted to the clothes load. Too little mechanical energy will typically mean that the clothes load is not cleaned to the desired standard, particularly for certain soils which require mechanical force to be removed. Too much mechanical energy will get the clothes cleaned to the desired standard, but it wastes resources (extra energy consumption) in doing so and adds additional wear or fabric damage to the fabric items.

It would be advantageous to the overall cleaning performance if the mechanical energy imparted to the fabric items could be determined during the washing process.

SUMMARY OF THE INVENTION

A method for controlling the operation of an automatic clothes washer based upon the work imparted to the fabric items by an article mover and a sensor for detecting the amount of work imparted to the fabric items.

DESCRIPTION OF AN EMBODIMENT OF THE INVENTION

The invention relates a method and sensor for determining the mechanical action imparted by a clothes mover to a laundry load in an automatic clothes washer, which can then be utilized in establishing the duration of a selected laundering cycle. The method and sensor utilizes operational characteristics of a drive motor, such as angular velocity or current, to determine the mechanical action imparted to the laundry load. The quantification of the mechanical action can then be utilized to determine the length of the laundering cycle.

Conventional automatic clothes washers enable a user to select one of several laundering options based upon the type of laundry load being placed in the clothes washer. For example, selectable options can include "normal," "delicates," "woolens," and the like. These are typically referred to as "cycles." As utilized herein, "laundering cycle" will refer to a specific cycle, such as "normal," extending from the beginning of the cycle to its completion. A laundering cycle will generally consist of at least a wash cycle, a rinse cycle, and a spin cycle. The wash cycle, the rinse cycle, and the spin cycle may consist of several steps, such as a fill step, a drain step, a pause step, an agitation step, and the like. Since it is the wash cycle which is responsible for cleaning effectiveness, the invention is used in a wash cycle for any laundering cycle regardless of the types and combination of steps.

Figure 1:
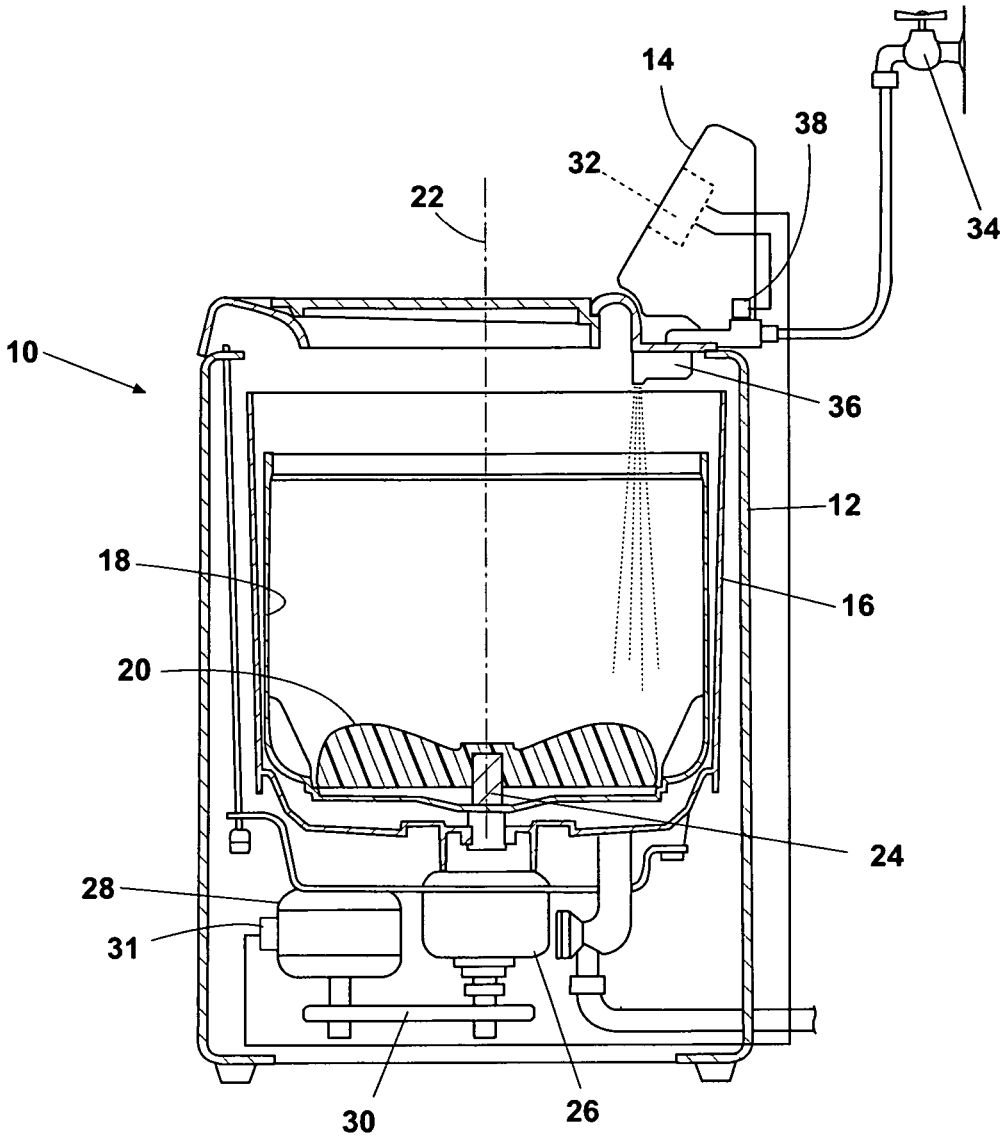
FIG. 1 is a partially cut away elevational view of an automatic clothes washer according to the invention illustrating relevant internal components thereof, including a clothes basket, and a clothes mover.

FIG. 1 illustrates an embodiment of the invention consisting of a vertical axis automatic clothes washer 10 comprising a cabinet 12 having a control panel 14, and enclosing a liquid-tight tub 16 defining a wash chamber in which is located a perforate basket 18. Thus, fabric items placed in the basket 18 are placed in the wash chamber. A clothes mover 20 adapted for imparting mechanical energy to a laundry load contained within the basket 18 can be disposed in the bottom of the basket 18. The clothes mover 20 is illustrated as a low profile vertical axis impeller. However, the clothes mover 20 can also be a vertical axis agitator, with or without an auger, or a basket adapted with peripheral vanes. The clothes mover 20 and basket 18 can be coaxially aligned with respect to a vertically oriented oscillation axis 22.

While the invention will be illustrated with respect to a low profile impeller, other clothes movers can be utilized without departing from the scope of the invention. For example, it is contemplated that the invention has applicability to horizontal axis washers as well as to the vertical axis washers. For purposes of this application, horizontal axis washer refers to those types of washers that move the fabric items primarily by lifting the fabric items and letting them fall by gravity, regardless of whether the axis of rotation is primarily horizontal, and vertical axis washer refers to those types of washers that move fabric items by a clothes mover, regardless of whether the axis of rotation is primarily vertical.

The clothes mover 20 can be operably connected to a drive motor 28 through an optional transmission 26 and drive belt 30. Alternatively, the motor drive 28 can be directly connected to the clothes mover 20. One or more well-known sensors 31 for monitoring angular velocity, current, voltage, and the like, can be operably connected to the motor 28. The sensors 31 can be a combination of one or more physical sensors, such as a tachometer, a hall effect sensor, and the like, with virtual sensors comprising algorithms which estimate the desired physical parameters, such as speed or position, in an indirect manner by measuring some other variables, such as current, voltage, and the like.

Outputs from the sensors 31 can be delivered to a machine controller 32 in the control panel 14. The type and configuration of motor controller, sensors 31, and machine controller 32 are not germane to the invention. Any suitable control system can be used that can output the motor data, such as speed and current. In many applications, the sensors 31 form part of a motor controller coupled to the machine controller 32. The machine controller 32 can be adapted to send and receive signals for controlling the operation of the clothes washer 10, receiving data from the sensors 31, processing the data, displaying information of interest to a user, and the like.

The clothes washer 10 can also be connected to a source of water 34 which can be delivered to the tub 16 through a nozzle 36 controlled by a valve 38 operably connected to the machine controller 32. The valve 38 and the machine controller 32 can enable a precise volume of water to be delivered to the tub 16 for washing and rinsing.

Figure 2:
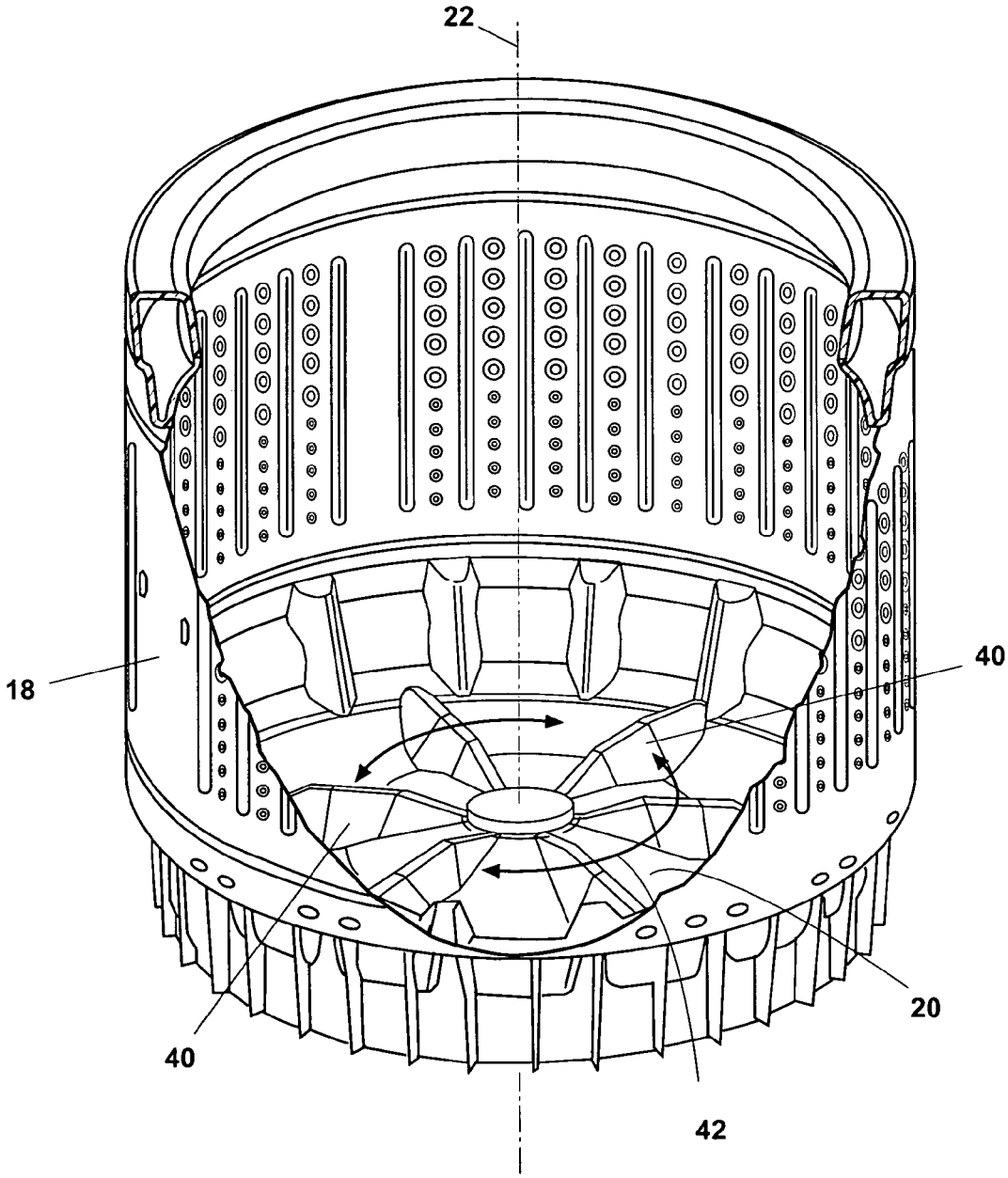
FIG. 2 is a partially cut away perspective view of the clothes basket and clothes mover illustrated in FIG. 1.

FIG. 2 illustrates the clothes basket 18 and the clothes mover 20 in coaxial alignment with the oscillation axis 22. The clothes mover 20 can be a somewhat circular, platelike body having a plurality of radially disposed vanes 40 extending upwardly therefrom. The vanes 40 can be adapted to contact and interact with fabric items and liquid in the basket 18 for agitating the fabric items and the liquid. During a wash cycle and a rinse cycle, the clothes mover 20 can be driven by the drive motor 28 for movement within the wash chamber. The basket 18 can be braked to remain stationary during the movement of the clothes mover 20, or the basket 18 can freely rotate during the movement of the clothes mover 20.

The drive motor 28 can drive the clothes mover 20 in an oscillating manner, first in a forward direction, referred to herein as a forward stroke, then in a backward direction, referred to herein as a backward stroke. The clothes mover 20 can move in a forward direction through a preselected angular displacement, for example ranging from 180° to 720°. The clothes mover 20 can move in a backward direction through a similar preselected angular displacement. A complete forward stroke and backward stroke is referred to herein as an oscillation cycle.

In a typical wash cycle, multiple fabric items, which collectively form a laundry load, are placed in the basket on top of the clothes mover 20. Some of the fabric items will be in direct contact with the clothes mover 20 and some will not. As the clothes mover 20 moves, the individual fabric items will be moved directly or indirectly by the clothes mover 20 to impart mechanical energy to the items, which will move the fabric items about the interior of the wash chamber.

Figure 3:
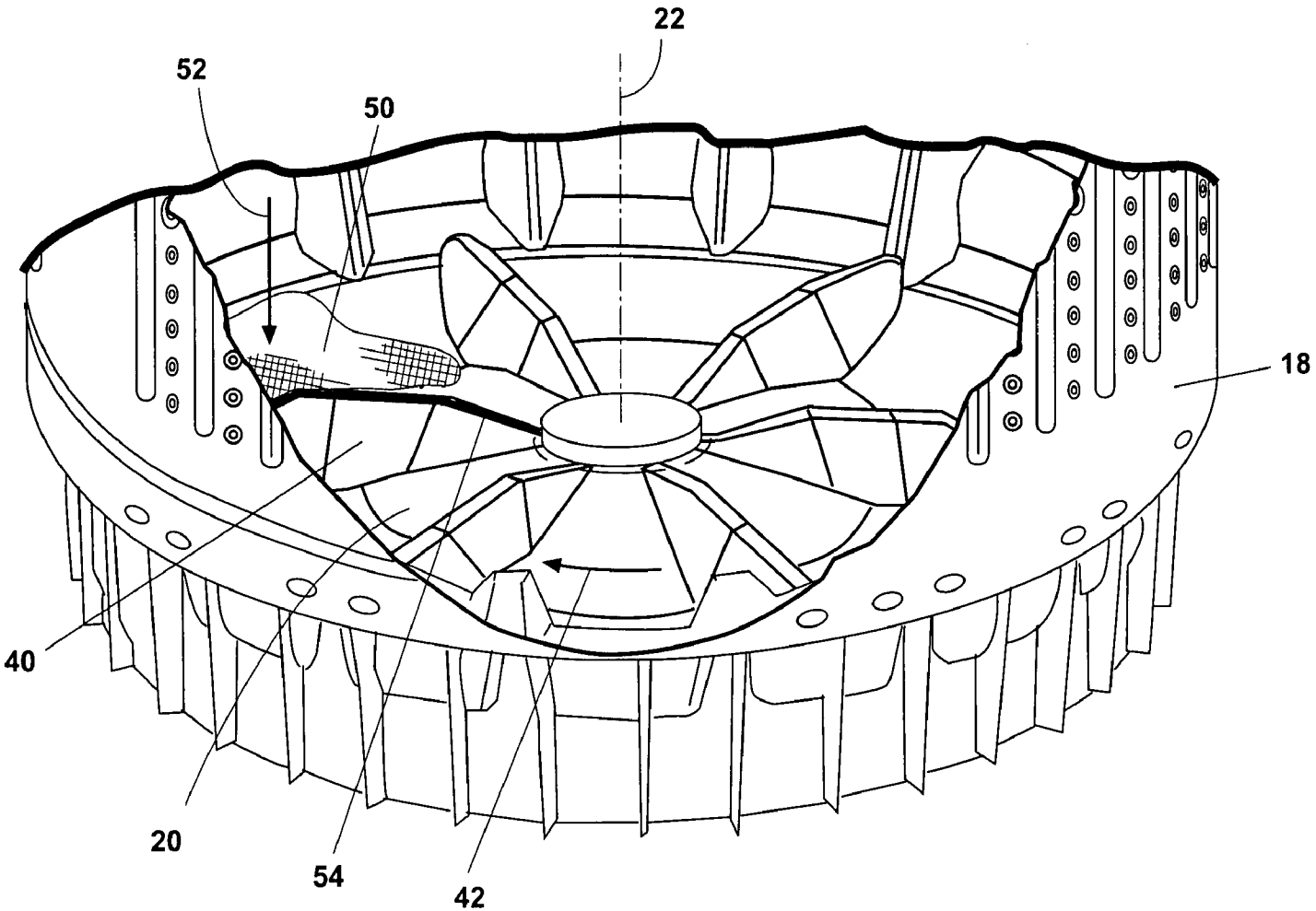
FIG. 3 is a partially cut away enlarged view of the clothes basket and clothes mover illustrated in FIG. 2 showing an article of clothing in a first configuration relative to the clothes mover.
Figure 4:
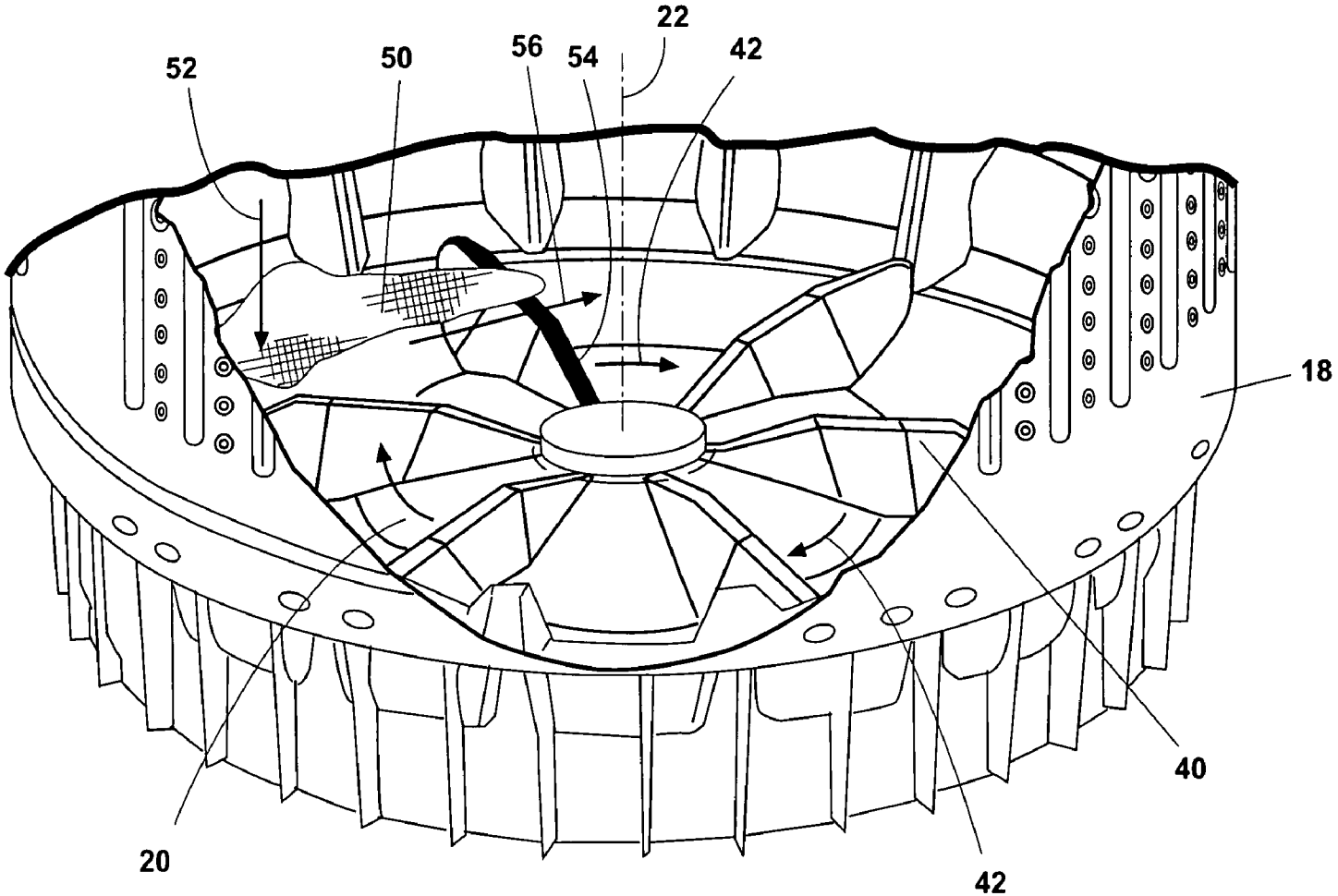
FIG. 4 is a view of the clothes basket and clothes mover illustrated in FIG. 3 showing the article of clothing in a second configuration relative to the clothes mover.
Figure 5:
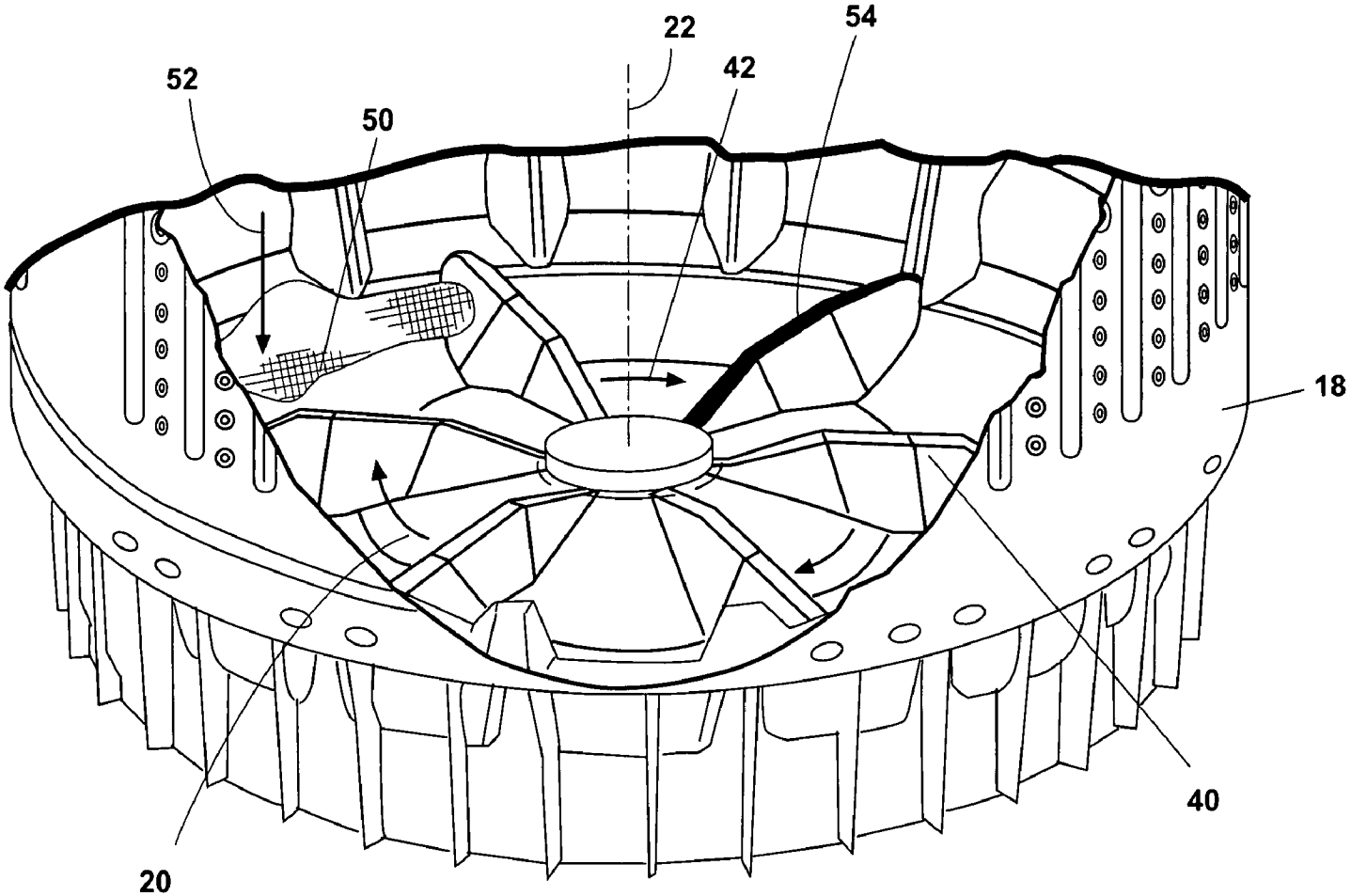
FIG. 5 is a view of the clothes basket and clothes mover illustrated in FIG. 3 showing the article of clothing in a third configuration relative to the clothes mover.

FIGS. 3-5, illustrate the movement of a single fabric item 50 that is in contact with the clothes mover 20. No liquid is illustrated for clarity in FIGS. 3-5. However, it should be understood that liquid is present and it can be at any level from just wetting the fabric items to fully submerging the fabric items.

As illustrated in FIG. 3, the fabric item 50 in a lower portion of a laundry load will be in contact with the clothes mover 20. The fabric item 50 can be represented by a downwardly directed weight factor 52. The vanes 40 terminate in an upper vane edge 54. All or part of the vane 40 can contact the fabric item 50 during the forward and backward strokes of the clothes mover 20. As the clothes mover 20 is rotated in a forward stroke, represented by the motion vector 42, a vane 40 can be brought into contact with the fabric item 50.

Referring now to FIG. 4, the contacting of the vane 40 with the fabric item 50 tends to move the fabric item 50 in the direction of rotation of the clothes mover 20, represented by the pull vector 56. Because of the weight of the fabric item 50, the weight of overlying fabric items, the frictional relationship between the fabric item 50 and the vane edge 54, the degree of wetting of the fabric item 50, and other factors, there can be intermittent contacting and slipping by the vane 40 relative to the fabric item 50 which will be reflected in movement of the fabric item 50 that may not be the same rotational distance as the clothes mover 20, resulting in relative movement between the fabric item 50 and the clothes mover 20. As illustrated in FIG. 5, if there is sufficient slippage, at some point during the forward stroke the vane 40 can separate from the fabric item 50.

The intermittent contacting and slipping of the vane 40 with respect to the clothes mover 20 results in an intermittent engagement of the fabric item with the clothes mover 20 by the application of the weight of the fabric item 50 to the clothes mover 20, which amounts to a loading and unloading of the clothes mover 20. The engagement and disengagement associated with the loading and unloading present as a change in speed of the clothes mover 20, which is sensed by the sensors 31. In response, the controller 32, which typically tries to move the motor 28 at a predetermined set speed for the given cycle, will increase or decrease the current to the motor 28 to attempt to maintain the set speed.

The magnitude and frequency of engagement is impacted by several factors, only some of which will now be described. If multiple fabric items comprise the load, then when multiple fabric items bear on each other, their collective weight will impact clothes mover. Thus, all else being equal, the greater the size of the laundry load, the greater will be the loading of the clothes mover by the fabric items. The increased volume of the greater laundry load will also tend to inhibit the free movement of the fabric items within the wash chamber, which will tend to keep the fabric items in contact with the basket 18 or the clothes mover 20 as there is less space for the fabric items to move and their individual free movement is inhibited by surrounding fabric items. Wet fabric items tend to create greater frictional resistance with the clothes mover than dry fabric items due to greater normal force.

However, as liquid level increases in the wash chamber to the point where the fabric items are fully submerged, the additional liquid brings into effect the buoyancy of the fabric items, which has an opposite effect than the weight force of the fabric items. In some instances, the liquid may be sufficiently deep and the clothes mover may sufficiently agitate the liquid that some or all of the fabric items are suspended in the liquid above the clothes mover 20, which will greatly reduce the loading of the clothes mover 20 by the fabric items. All things being equal, when the liquid level is high, the loading due to the clothes load is less. Thus, the deeper the liquid, the more the degree of loading and unloading will be minimized.

Looking at particular scenarios, if the clothes washer 10 contains only liquid, i.e. no fabric items, the loading/unloading of the clothes mover 20 is minimal to nonexistent during the oscillation cycle because the clothes mover 20 is, for the most part, in contact with the same amount of liquid throughout each stroke, which essentially places a generally constant load on the clothes mover 20.

Figure 6:
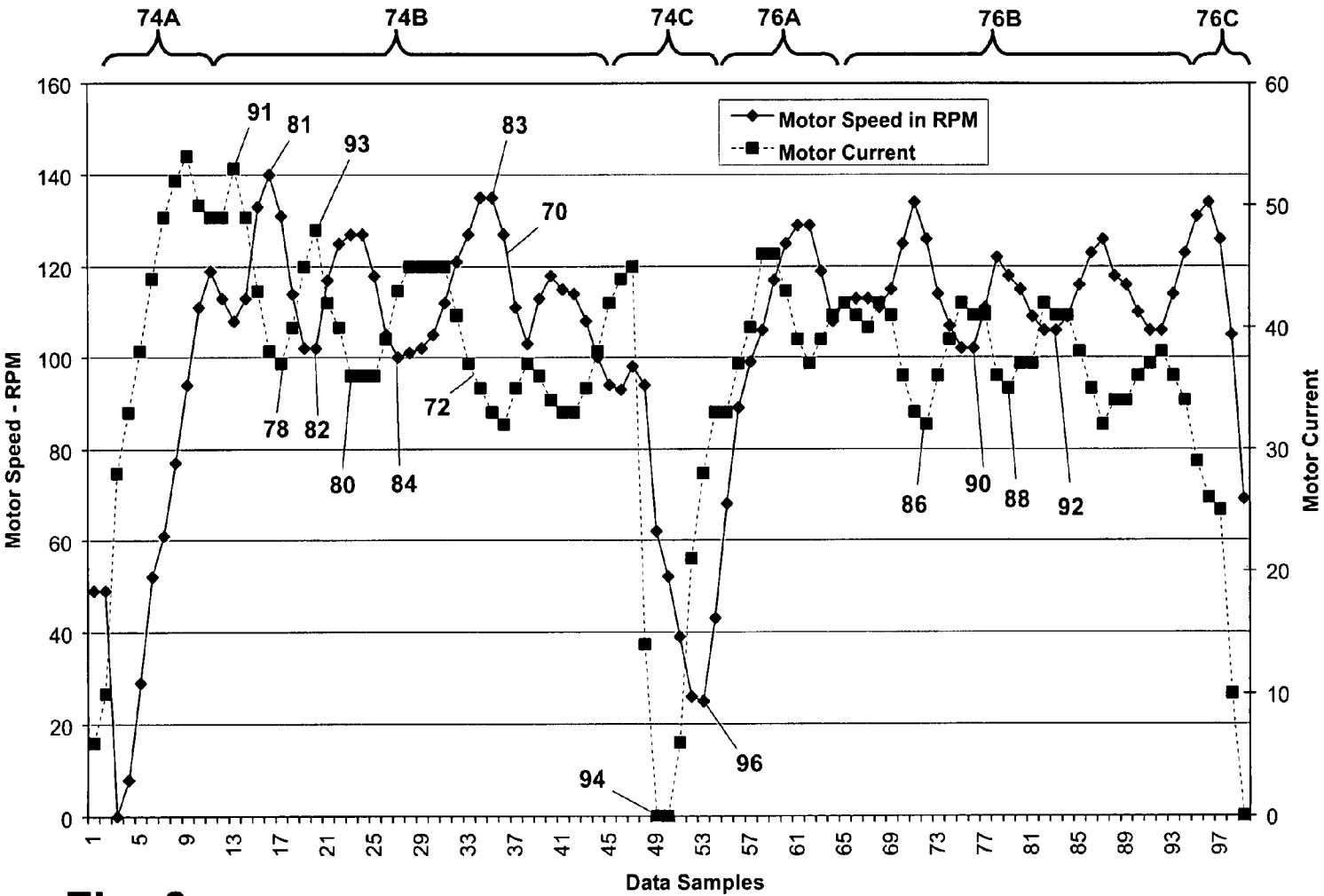
FIG. 6 is a first graphical representation of motor speed and motor current for the automatic clothes washer illustrated in FIG. 1 during a single oscillation cycle of the clothes mover consisting of a forward rotational stroke followed by a backward rotational stroke.

FIG. 6 graphically illustrates a waveform of the motor speed 70 and motor current 72 for a laundry load which is evenly distributed throughout the wash basket, i.e. there is little or no rotational asymmetry of the clothes load relative to the clothes mover 20. Current can be motor phase current or dc bus current or any current in the motor controller which has a correlation with output motor torque and power. The waveform of the motor speed 70 and the motor current 72 illustrates a forward stroke, represented by a forward direction region 74, followed by a backward stroke, represented by a backward direction region 76. The waveforms of FIG. 6 are generated by sampling the motor speed 70 and motor current 72 at a predetermined interval or sampling rate, which in this case is 20 milliseconds.

As illustrated, in the forward direction region 74 the movement of the clothes mover during the forward stroke can be divided into an acceleration step 74A, where the clothes mover 20 is quickly accelerated to a predetermined set speed, a maintain speed step 74B, where the motor speed is maintained at the predetermined set speed, and a deceleration step 74C, where the clothes mover is quickly decelerated for reversal, which can include braking, prior to reversing. Step 74B is often referred to as the plateau.

The backward direction region 76 is similarly divided into an acceleration step 76A, a plateau 76B, and a deceleration step 76C. Thus, when the clothes mover 20 transitions from the forward stroke to the backward stroke, the motor current 72 decreases to a zero value 94, and the motor speed 70 responsively decreases to a zero or nearly zero value 96. While the decrease in speed is not shown going to zero in FIG. 6, this is a result of the sampling rate for the data points—the zero speed was not sampled—not an indication that the speed does not go to zero. In reality, whenever the clothes mover 20 changes direction, there is necessarily a point, which might be instantaneous, where the speed is zero.

During the forward and backward strokes as illustrated in FIG. 6, the controller 32 controls the speed of the motor 28 in an attempt to maintain the motor speed at a predetermined set speed, which for the example in FIG. 6 is 120 RPM. Thus, the speed of the clothes mover 20 is essentially constant at approximately the 120 RPM set speed in the plateau 74B, 76B of the curve 70. There are nominal variations or ripples in the motor current 72 and motor speed 70 in the plateaus 74B, 76B due to the nominal loading and unloading of the laundry load on the clothes mover 20 associated with the engagement of the clothes mover 20 with the fabric items as the clothes mover 20 moves. This loading and unloading is transmitted through the clothes mover 20 and the transmission 26 to the drive motor 28 where it is sensed by speed sensors 31. The loading and unloading causes transient fluctuations in the speed of the clothes mover 20 relative to the set speed. In response, the controller 32 adjusts the current to the motor 28 in an attempt to maintain the set speed, which results in the motor current leading the speed as illustrated in FIG. 6.

The contacting and slipping between the clothes mover 20 and the laundry load is reflected in the relatively high frequency ripples in both motor speed 70 and motor current 72. As FIG. 6 illustrates, the frequency of the ripples during the forward and backward strokes is essentially the same.

The frequency of each ripple can be determined from the time or period of each ripple by using successive reference points, such as a ripple maximum 91, 93 or a ripple minimum 78, 80. Looking more closely at the ripples of the motor speed waveform 70, the ripples can be separated into peaks comprising both positive peaks 81, 83 and negative peaks 82, 84. The frequency can be determined from successive peaks. The amplitude or magnitude of the ripples can also be determined by comparing the peaks to the motor speed set point. For example, the difference between the positive speed amplitude 81 and the target rotation speed can be a first amplitude value. Similarly, the difference between the negative speed amplitude 84 and the target rotation speed, expressed as an absolute value, can be a second amplitude value. The motor speed 70 has a quasi-sinusoidal waveform for which a frequency can be determined using the peaks for the time of the plateau 74B, 76B.

As with the oscillations in motor speed and current occurring during a forward stroke, the frequency of the oscillations during a backward stroke can also be determined. For example, the frequency can be determined from a cycle start point 86 and a cycle end point 88 for motor current, or from a cycle start point 90 and a cycle end point 92 for motor speed.

The frequency and amplitude values can be stored by the machine controller 32. With the frequency values associated with the forward stroke, preselected mathematical operations can be performed by the machine controller 32 on the frequency values.

The waveform of the motor current 72 is similar to that of the motor speed 70 in that the ripples can be separated into peaks comprising positive peaks 91, 93 and negative peaks 78, 80. The peaks of the current waveform can also be used to calculate a frequency for the waveform.

As illustrated in FIG. 6, the motor current waveform is generally similar to the motor speed waveform and the current tends to lead the speed. The leading of the current relative to the motor speed is a result of the controller attempting to maintain the motor speed at the set speed. Because the magnitude of the current is determined by the controller as necessary to maintain the set speed, the motor current does not have a corresponding set point in the way that the motor speed has a set point.

The frequency and amplitude values for either or both of the motor speed and motor current can be stored by the machine controller 32 or a motor controller as individual data values as well as a cumulative value. The values can be averaged, and a running average can be determined and stored by the machine controller 32.

While waveforms containing data for the motor speed and the motor current have been available to those skilled in the art for a long time, Applicants have determined that the information embedded in the superimposed waveform on top of motor speed or current can be used to determine the amount of mechanical energy or work delivered to the laundry load by the clothes mover 20. In fact, the amplitude of the superimposed waveform indicates the amount of friction between the fabric items and the clothes mover, and the frequency of this waveform can be used to calculate the motor speed. Additionally, this mechanical energy or work is determined from the motor speed data and motor current data in real-time. In this sense, the proposed method can be viewed as a real-time sensor placed in the wash chamber for determining mechanical energy or work. Such a sensor has never before been available.

The ability to determine or sense the mechanical energy or work is very beneficial to improving the laundering performance. The interaction of the vanes 40 with the laundry load results in mechanical action or work being delivered to the laundry load, which can both contribute a laundering effect to the load and cause abrasion, fracture, and wear of the fabric items. Some mechanical action is needed to obtain the desired amount of laundering. Mechanical action beyond that needed to launder the fabric items is not needed and not desired as it wears the fabric items without additional laundering benefit. Also, for some fabric items, especially delicate fabric items, it is desirable to keep the mechanical action below a predetermined magnitude. Therefore, it is important to control the amount of mechanical energy or work delivered to the laundry load by the clothes mover 20. To control the mechanical energy, it is necessary to know the mechanical energy delivered to the clothes load.

Once one has the ability to determine the amount of mechanical energy or work, it is then possible to manipulate the wash cycle accordingly to control the amount of mechanical energy or work delivered to the laundry load. In essence, the wash cycle will be adjusted or terminated after a preselected amount of mechanical energy or work has been delivered to the laundry load.

The relationship between the motor speed and motor current and the amount of mechanical energy or work delivered to the laundry load will be considered in greater detail. The frequency and amplitude of the motor speed or current ripples can provide an accurate estimate of the amount of mechanical energy or work delivered to the laundry load, thereby enabling the duration of the wash cycle to be set.

It has been determined that work done by a clothes mover on a laundry load can be given by the following relationship:

$$MA=\text{Force}*\text{Displacement}=\text{Torque}*\text{Angular Displacement}$$

where

MA=mechanical action (or work) acting on laundry load,

Force=force imposed by clothes movers or its vanes on laundry load,

Displacement=relative displacement of laundry load with respect to clothes mover due to force imposed by vanes, Torque=torque experienced by laundry load, generated by interaction of vanes and laundry load, taken about rotational axis, and Angular Displacement=relative angle of rotation of clothes load with respect to the mover.

The torque can be equated with the friction-torque produced by the friction force F, given by the following relationship:

$$F=\mu*N$$

where

F=friction force,

μ=coefficient of friction between laundry load and vanes, and

N=normal force perpendicular to direction of friction force.

The coefficient of friction μ is a function of the fabric type, the detergent type and quantity, the temperature of the laundry load and liquid, and the material from which the clothes mover is fabricated. However the coefficient of friction μ is primarily a function of the fabric type. The friction force F is a function of the laundry load size and the fabric type, and is reflected in the amplitude of the oscillations in motor speed or motor current that are observed during a clothes mover stroke.

Friction torque, i.e. the torque developed as a result of the friction between the laundry load and the clothes mover 20, can be given by the following relationship:

$$T=\mu*N*Avg\ \text{Radius Clothes Mover}$$
$$=\text{Amplitude}*k$$

where

T=friction torque,

Avg Radius Impeller=the average radius of the clothes mover 20,

Amplitude=Amplitude (peak) of quasi-sinusoidal oscillations in current or motor speed, and k=constant of proportionality, which is function of average impeller radius and is constant for specific automatic clothes washer model.

Figure 7:
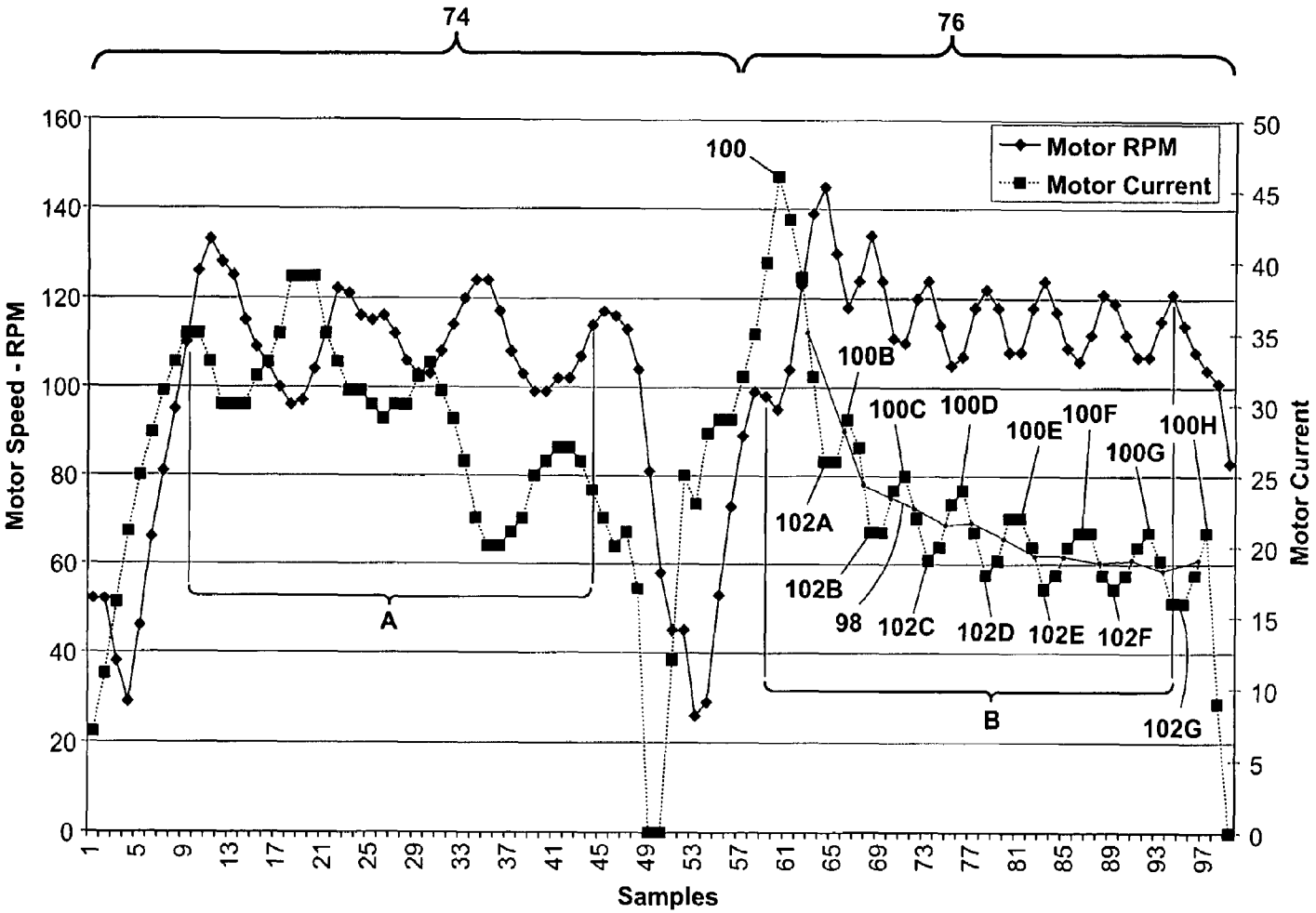
FIG. 7 is a second graphical representation of motor speed and motor current for the automatic clothes washer illustrated in FIG. 1 during a single oscillation cycle of the clothes mover consisting of a forward rotational stroke followed by a backward rotational stroke.

Referring now to FIG. 7, the quasi-sinusoidal ripple waveform can be determined by subtracting a trend waveform 98 from the speed or current waveform in the plateau region, i.e. the region representing an ideally constant motor speed equal to the set target speed. These plateau regions are identified as regions A and B in FIG. 7. The trend waveform can be calculated using alternate methods. For example, the trend waveform 98 can be plotted by determining the midpoints of the alternating upwardly-trending and downwardly-trending waveform segments, such as segments 100A-102A, 102C-100D, or 100F-102F, and establishing a line through the points. The trend waveform is preferably determined using a moving average calculation, also referred to as a moving average filter. The moving average is calculated using sets, or "windows," of 8 successive data samples over the plateau region of interest. For example, the data points for plateau region B in FIG. 7 would include sample number 59 through sample number 95. The first iteration of the moving average calculation would involve samples 59-66. The window is then advanced, hence the name "moving," one data point such that the second iteration would involve samples 60-67. The window is advanced one data point at a time until the last window, which involves samples 88-95. The average of the 8 data points comprising each set or window is calculated and used to establish the trend line.

The frequency range of the quasi-sinusoidal ripples, or "AC" component of the waveform, is typically within the range of 4 HZ to 16 HZ. The use of 8 data points in the moving average calculation has been found to give acceptable results for this frequency range. Although a preferred number of samples for the moving average calculation is 8, the number of samples can be any other selected number based upon the desired accuracy of the trend line, computational capabilities, component size, and cost constraints of the automatic washer operational system.

The difference between each maximum or minimum amplitude value and the trend line value is then calculated, with all values treated as absolute values for purposes of the Amplitude term. The amplitude of the quasi-sinusoid waveform can be estimated using alternate methods. Rather than using the peak value of the ripple waveform, any metric that is a function of the amplitude of the ripple frequency can be used. For example, the area under the absolute value of the ripple waveform is proportional to the amplitude of the ripple waveform. Thus, the area can be used as representing the Amplitude for purposes of the above algorithm.

Angular Displacement is determined from the ripple frequency. The mean frequency of the ripples in motor speed or motor current during the $m^{th}$ forward and backward stroke pair can be given by Avg $Freq_F(m)$ and Avg $Freq_B(m)$, respectively, and is simply the sum of the individual frequency values during the $m^{th}$ forward stroke divided by the number of frequency values during the $m^{th}$ forward stroke, and the sum of the individual frequency values during the $m^{th}$ backward stroke divided by the number of frequency values during the $m^{th}$ backward stroke. For example, the number of frequency values during the forward stroke in FIG. 6 is 5, and the number of frequency values during the backward stroke in FIG. 6 is 4.

The angular distance swept by the fabric items 50 relative to the clothes mover 20 can be given by the following relationships:

$$\text{Angular Disp}_F(m)=k1*\text{Avg Freq}_F(m), \text{ and}$$

$$\text{Angular Disp}_B(m)=k1*\text{Avg Freq}_B(m).$$

The constant of proportionality k1 is independent of laundry load size and fabric type, and is strictly a function of clothes mover geometry.

The mechanical action for the $m^{th}$ stroke pair MA (m) can be given by the following relationships:

$$MA(m)\propto\{\text{Torque}_F(m)*\text{Angular Disp}_F(m)+\text{Torque}_B(m)*\text{Angular Disp}_B(m)\}, \text{ and}$$

$$MA(m)=k2*\{\text{Ampl}_F(m)*\text{Avg Freq}_F(m)+\text{Ampl}_B(m)*\text{Avg Freq}_B(m)\}.$$

The constant of proportionality k2 is a function of fabric type. $\text{Ampl}_F(m)$ is the total amplitude value of the oscillations during the $m^{th}$ forward stroke, and $\text{Ampl}_B(m)$ is the total amplitude value of the oscillations during the $m^{th}$ backward stroke.

Total mechanical action TMA due to a total of M stroke pairs or oscillation cycles can be given by the following relationship:

$$TMA = k2\sum_{m=1}^{M} MA(m).$$

During a wash cycle, for example, the machine controller 32 samples the output from a sensor, such as a motor speed sensor, every 20 milliseconds, and stores the data in memory. The controller determines the frequency and amplitude values described above and calculates a running total TMA of the mechanical action. The running total is compared to a preselected threshold value of total mechanical action $TMA_T$ which is established based upon factors such as fabric type, laundering cycle, clothes mover configuration, motor type, transmission type, and the like. The predetermined threshold value $TMA_T$ preferably represents an optimal combination of cleaning effort and fabric protection, but can be any predetermined value based on selected criteria. When the calculated value TMA reaches the preselected threshold value $TMA_T$, the controller can initiate a step in the laundering cycle, such as setting a cycle time, adjusting a cycle time, terminating a cycle, adding a cycle, adding a step, transitioning to a cycle, adding water, adding a laundry chemical, initiating a pause and drain, obtaining a turbidity measurement, and the like.

The invention described herein provides an optimized laundering cycle by reducing the total cycle time to a period sufficient for satisfactorily cleaning a laundry load, thereby reducing energy usage. At the same time, optimizing the laundering cycle minimizes the progressive wear to the laundry load caused by over agitating the items. Thus, fabric items being laundered have an enhanced lifespan, thereby saving the consumer costs related to replacement of such items. Finally, the utilization of motor speed or motor current in determining an optimal laundering process requires no additional instrumentation, thereby minimizing additional cost. The invention simply utilizes readily available information in a new manner to control an operation in order to optimize the laundering performance of a clothes washer, i.e. to optimize cleaning effectiveness while preserving fabric care.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for controlling the operation of an automatic washer comprising a wash tub in which is disposed a wash basket defining a wash chamber for receiving fabric articles and an article mover located within the wash chamber and driven by a motor to impart mechanical energy to the fabric articles upon contact, the method comprising:

determining an amplitude and a frequency of one of a motor speed ripple waveform and a motor current ripple waveform;

determining the work imparted to the fabric articles by the article mover from the amplitude and frequency of the one of the motor speed ripple waveform and the motor current ripple waveform; and controlling an operating cycle of the automatic washer based on the determined work;

wherein the motor speed ripple waveform and a motor current ripple waveform comprises ripples due to the loading and unloading of the fabric articles on the article mover.

2. The method according to claim 1, wherein the determining of the work comprises determining the product of the amplitude and the frequency for the ripples in one of the motor speed ripple waveform and the motor current ripple waveform.

3. The method according to claim 2, wherein multiple products are determined at different points in time, and the determining of the work comprises determining the average of the multiple products.

4. The method according to claim 1, wherein the determining of the work comprises summing the absolute values of the areas of the ripples in one of the motor speed and motor current above and below a preselected motor speed or motor current value.

5. The method according to claim 1, wherein the determining of the work comprises maintaining a running total of the work.

6. The method according to claim 5, wherein the controlling of the operating cycle comprises comparing the running total of the work to a predetermined threshold value.

7. The method according to claim 5, wherein the maintaining of a running total of the work comprises summing the work for each stroke of the article mover.

8. The method according to claim 7, wherein the summing of the work for each stroke comprises summing a product of an amplitude and a frequency of the ripples in one of a motor speed and a motor current for each stroke.

9. The method according to claim 8, wherein multiple products are determined at different points in time, and the summing of the work for each stroke comprises summing the average of the multiple products for each stroke.

10. The method according to claim 7, wherein the summing of the work for each stroke comprises summing the absolute values of the areas of the ripples in one of the motor speed and motor current above and below a preselected motor speed or motor current value.

11. The method according to claim 3, wherein the average is determined for each stroke.

12. The method according to claim 3 and further comprising determining a running total of the average.

13. The method according to claim 2, and further comprising determining a running total of the product.

14. The method according to claim 2, wherein the controlling of the operating cycle comprises at least one of: setting a cycle time, adjusting a cycle time, terminating a cycle, adding a cycle, adding a step, transitioning to a cycle, adding water, adding a laundry chemical.

15. The method according to claim 1, wherein the controlling of the operating cycle comprises at least one of: setting a cycle time, adjusting a cycle time, terminating a cycle, adding a cycle, adding a step, transitioning to a cycle, adding water, adding a laundry chemical.

16. The method according to claim 1, wherein the controlling of the operating cycle is determined based on a selected cycle.

17. The method according to claim 1, wherein the controlling of the operating cycle comprises comparing the work to a predetermined value.

18. The method according to claim 1, wherein the determining of the work is done in real-time.

* * * * *